US012760601B2

(12) United States Patent
Williams

(10) Patent No.: US 12,760,601 B2
(45) Date of Patent: Oct. 13, 2026

(54) DOWNHOLE MOTOR AND RELATED SYSTEMS AND METHODS FOR CONTROLLING FORMATION CONTACT POINTS

(71) Applicant: Supreme Source Energy Services, Inc., Katy, TX (US)

(72) Inventor: Danny T. Williams, Katy, TX (US)

(73) Assignee: Supreme Source Energy Services, Inc., Katy, TX (US)

( * ) Notice: Subject to any disclaimer, the term of this patent is extended or adjusted under 35 U.S.C. 154(b) by 0 days.

(21) Appl. No.: 19/287,055

(22) Filed: Jul. 31, 2025

(65) Prior Publication Data

US 2026/0035999 A1 Feb. 5, 2026

Related U.S. Application Data

(60) Provisional application No. 63/677,784, filed on Jul. 31, 2024.

(51) Int. Cl.
*E21B 7/06* (2006.01)
*E21B 4/02* (2006.01)

(52) U.S. Cl.
CPC ..... *E21B 7/062* (2013.01); *E21B 4/02* (2013.01)

(58) Field of Classification Search
CPC ..... E21B 7/062; E21B 7/068
See application file for complete search history.

(56) References Cited

U.S. PATENT DOCUMENTS

| | | | | |
|---|---|---|---|---|
| 4,962,818 | A * | 10/1990 | DeLucia | E21B 7/068 418/48 |
| 5,857,531 | A * | 1/1999 | Estep | E21B 17/20 175/101 |
| 7,311,157 | B1 * | 12/2007 | Clarke | E21B 7/067 175/74 |
| 2014/0360787 | A1 * | 12/2014 | Williams | E21B 7/062 175/73 |
| 2015/0034390 | A1 * | 2/2015 | Roberts | E21B 7/067 175/73 |

* cited by examiner

*Primary Examiner* — David Carroll
(74) *Attorney, Agent, or Firm* — Kearney, McWilliams & Davis, PLLC; John M. DeBoer

(57) ABSTRACT

A downhole motor apparatus for use with a drillstring in drilling a wellbore. The downhole motor includes a power section operatively coupled with a bearing section. A drill bit is operatively connected with the bearing section. The power section has a power section housing, and the bearing section has a bearing section housing connected with the power section housing. The bearing section housing is a unitary piece having a first bend at a first bend angle. In operation the downhole motor provides three known or controlled contact points in the wellbore.

14 Claims, 10 Drawing Sheets

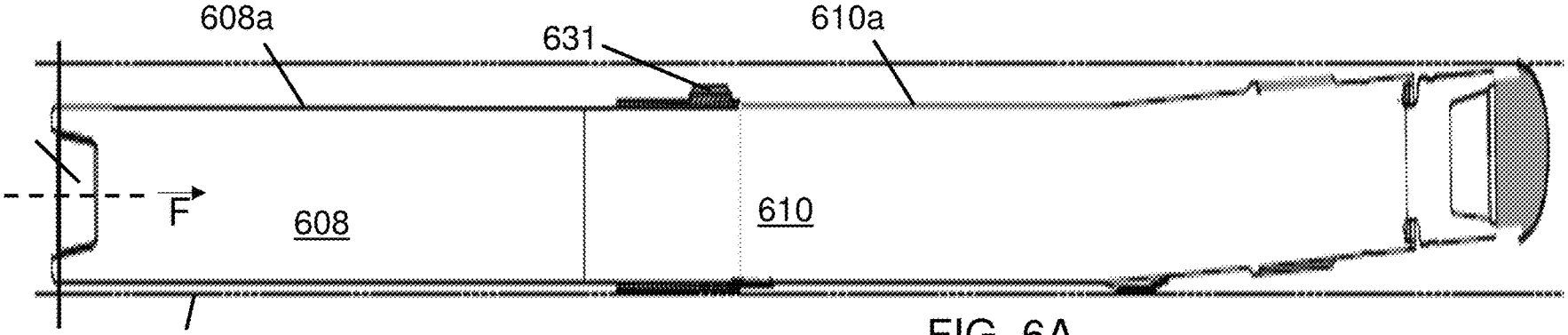
FIG. 6A
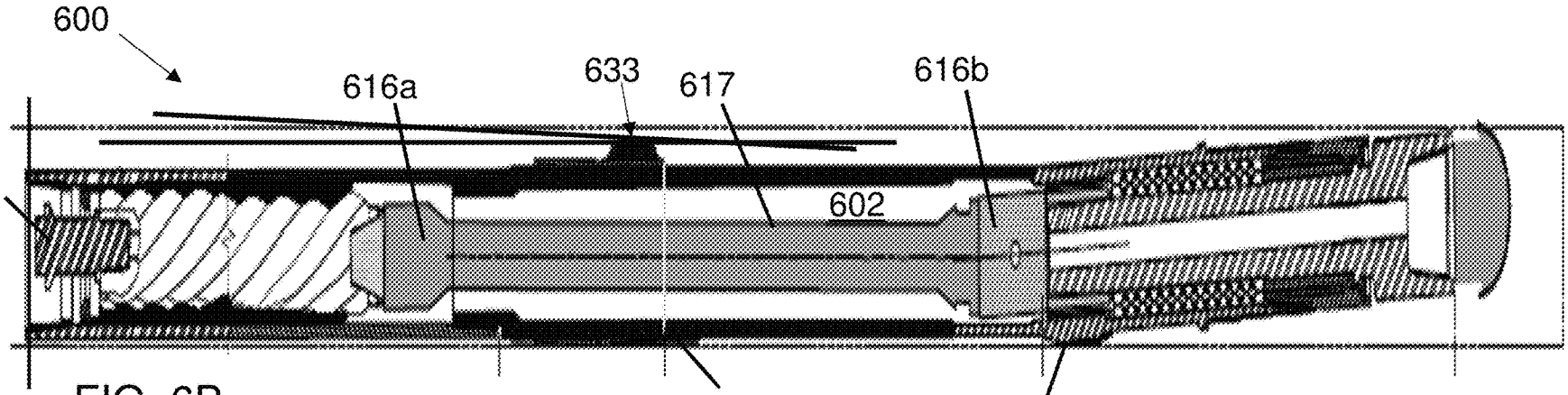
FIG. 6B
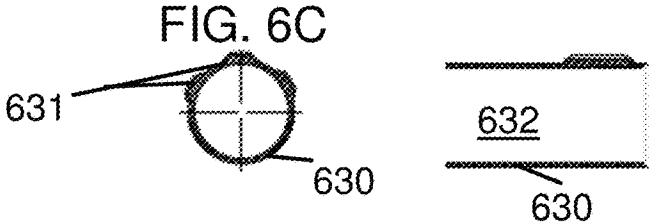
FIG. 6C
FIG. 6D

DOWNHOLE MOTOR AND RELATED SYSTEMS AND METHODS FOR CONTROLLING FORMATION CONTACT POINTS

BACKGROUND

Field of the Disclosure

Embodiments of the disclosure relate to downhole motors. Particular embodiments may relate to downhole motors used in drilling deviated and horizontal wellbores.

Background of the Disclosure

Downhole drilling motors are widely used in the oil and gas industry. Drilling motors are used to achieve high penetration rates, drill hard rock formations, and allow circulation (flow) of the wellbore. Over time drilling motors have increased drilling efficiency in the drilling of deviated holes, with several variant drilling motors now commonly used in the industry.

One common type of motor is known as a positive displacement motor (hereinafter "PDM"), which may be referred to as a mud motor. The PDM is energized by translation of high pressure and high-volume drilling fluid, air or gas through its various sections. As is known in the art, drilling motors like this have four basic components, namely the top-cross over sub, the power section, a bent section housing a transmission section, and the bearing section.

In the industry today, there are two primary modes of drilling: the rotary mode and the sliding mode. The rotary mode is used to keep the drill bit on a straight path, whereas with the rotary mode, the entire drill string and bottom-hole assembly (where the mud motor is located) is rotated while drilling.

Rotation of the drill string during drilling serves several important purposes. The rotation keeps the drill bit on a straight trajectory by cancelling out the effect of the bend in the motor. The rotation also reduces the frictional forces between the drill string and the bottom hole assembly and the wellbore by converting the static friction factor (that is created in the sliding mode) to a dynamic one and wherein the reduction of the frictional forces allows more of the applied weight to be transferred to the drill bit, which in turn can result in higher rates of penetration (ROP).

Rotation of the drill string reduces severity of the drill string buckling (that is created in the sliding mode). The rotation of the drill string will twist the drill pipe several wraps about its longitudinal axis, resulting in a relaxed stiffer member with an ability to transfer higher loads to the drill bit than a non-rotating drill string. The stiffer string facilitates drilling of long-reach horizontal and vertical wells, which is normally not possible with a stationary string due to severe buckling and frictional issues.

Further, rotation of the drill string and the bottom hole assembly (BHA) creates a stirring effect which helps lift settled drilled cuttings within the wellbore into the path of the returning drill fluid to the surface. This results in a cleaner, smoother wellbore, which attributes to a higher ROP and less friction when moving or removing drill pipe or casing in and out of the wellbore.

Nevertheless, operators find it necessary to drill in slide mode when necessary to deviate the wellbore to a desired path. For example, an operator will drill in slide mode when the drill bit strays from the intended well path. The slide mode is also used while drilling a curve or arc section in a horizontal well in order to land horizontally in a target zone at a desired true vertical depth.

It is common for a drill bit to deviate from desired trajectory for a multitude of reasons such as bit type, formation force characteristics, well bore inclination, and uni-directional rotation of the bit, to mention a few. Hence, the operator finds it necessary to bring the bit back into the intended path by steering it in the slide mode.

When drilling with a mud motor, the operator will steer the bit by switching from the rotary mode to the sliding mode. In the sliding mode, rotation of the drill string is halted, and the bend in the PDM of the bottom hole assembly (BHA) is pointed in the desired corrected or intended direction. Then drilling resumes, without rotating the drill string, in order to get the well path back on the intended path. Rotary drilling recommences when desired by the operator.

It is known by those in the art that reaching the desired path requires predictable and consistent build rates or dog legs of inclination and azimuth during the sliding mode. The functions of build rates and dog legs are dependent on multiple factors, including of which are the degree of bend in the PDM, the current inclination in the wellbore when performing the slide mode, the type of drill bit, formation, and weight on bit (WOB), to say the least.

One of the most difficult things to control while sliding for build rates or dog legs is obtaining consistent and reliable results. The main factor, currently not controllable, to obtain this accuracy is the ability to create three points of consistent contact that are needed to create a predictable arc.

Geometrically, with a single bend PDM, two of the three contact points are controllable, but the third is an unknown floating point (further dependent on current inclination and azimuth in the wellbore, and WOB).

For this reason, the industry is forced to run larger than desired bends that are used in the slide and rotation mode. Rotating these larger bends creates excessive radial forces on any connections below the bend in all current industry PDMs. This methodology is counterproductive and inefficient in being able to drill vertical well bore sections, curve wellbore sections and lateral well bore sections with one PDM and BHA in horizontal or high angle directional wells.

FIGS. 1A and 1B illustrate a schematic illustration, and a cross-sectional view, of a conventional bottom hole apparatus for drilling a well. FIGS. 1A and 1B together show a bottom hole apparatus 102 for drilling a wellbore 105. The apparatus 102 may be referred to as a down hole mud motor 102. An example may be any motor commercially available from National Oilwell Varco Inc. (for example, under the brand name Down Hole Drilling Mud Motor), and many others.

The power section 108 (with power section housing 108*a*) is the area of the motor 102 where conversion of hydraulic horsepower (such as of the drilling fluid, which may include fluid, air, foam, gas, combinations, etc.) to mechanical horsepower occurs. More specifically, the power section 108 operates to convert pumped drilling fluid (pressure) F into a rotational force, as understood by those of skill in the art. Ultimately, the rotational force is transferred from the power section 108 to a drill bit 101 (which is coupled with and resides by bit box 111) so that the wellbore 105 may be drilled.

The bit 101 may be roller cone bits, fixed cutter bits, or any other type of boring means to drill wellbores. The power section housing 108*a* may be (operatively) connected, such as by threads or the like, to a bent section housing 109*a*. It follows that the power section 108 may be operatively connected with a bent section 109, as may be applicable. In a similar manner, the bent section housing 109*a* may be (operatively) connected with a bearing section housing 110*a*, such as by threads or the like. It follows that the bent section 109 may be operatively connected with a bearing section 110, as may be applicable.

The bent section housing 109*a* may house or maintain a drift shaft (transmission) disposed or otherwise positioned therein. The drive shaft may have the (high-pressure) drilling fluid (air, foam, gas, etc.) therein, and that which makes the motor 102 steerable. The bearing section housing 110*a* may have bearings disposed therein, such as thrust bearings, (upper and lower) radial bearings, as known to one of skill. Also, the bearing section housing 110*a* is used to direct the drilling fluid to the drill bit 101, which helps to circulate and remove cuttings, as well as cool and lubricate the bit 101, among other things.

In the power section 108, a rotor stator member 113 is depicted, wherein a rotor head 114 of the rotor-stator member 113 is connected to a coupling unit, seen generally at 115. The coupling unit 115 typically includes one or more knuckle joints 116 or the like. The knuckle joint 116 is connected to a drive rod 117 (which may be referred to as the drive shaft 117) which in turn is connected to the second knuckle joint 116*a*. The coupling unit 115 is housed or disposed within the bent section housing 109*a*.

The bend section housing 109*a* includes a bend, seen generally at B, wherein the bend B has a bend angle a1 for the apparatus 102. The bend angle a1 may have different points of reference, but is generally understood to be with respect to a straight line (or planar) section of the bend section housing 109*a*.

Any motor 102 may use other means of power transfer, such as flex shafts, cv joints or any type of drive transmission suitable to convert motion from the power section 108 to direct drive to a power mandrel 121 (or sometimes a flow diverter). As shown, the second joint 116*a* is attached to the power mandrel 121, with the mandrel 121 housed or disposed within the bearing section housing 110*a*.

The power mandrel 121 has a first (e.g., upper) section 122*a* and a second (e.g., lower) section 122*b*. The bearing section 110*a* includes an upper radial bearing assembly 124 and a lower radial bearing assembly 125 are provided along with the thrust bearing assembly 126. The radial bearing assemblies 124, 125 absorb radial loads, while the thrust bearing assembly 126 absorbs thrust loads. A conventional motor with a single bend has a standard bend length L1 measurable from the bend B to an end 102*a* of the motor 102 proximate the bit box 111 and lower radial bearing assembly 125. The bend length L1 is selected as ample space to accommodate an adequate number of thrust bearings 126, and radial bearings 124, 125.

The two points of contact currently controllable in drilling are the drill bit 101 and the bend B in the PDM. The third point varies along the PDM and BHA when the well is at vertical, twenty-five degrees of inclination, fifty degrees of inclination, seventy degrees of inclination and finally when horizontal. The lower the inclination in the well the further away the third point of contact is from the first bend, the second point of contact, in the PDM. Geometrically the closer that third point can be from the bend, the second point, in the PDM, the greater and more consistent the build rate or dogleg can be.

As apparent, there is a current need for an apparatus, system, method, and related, for use or association with a PDM, which makes known or fixes a third contact point. There is a need for a PDM that produces more predictable and reliable build rates and dog legs. There is a need for an operator to run lower bend angles on the PDM then are currently being used, and still produce greater build rates and doglegs, while still being able to effectively rotate the PDM and BHA with greater rotational speeds. Higher rotational speeds produce higher rates of penetration (ROP) and cleaner well bores of cutting residue while reducing torque and drag within the well bore.

SUMMARY

Embodiments of the disclosure pertain to a downhole motor for use with a drillstring in drilling a wellbore. The downhole motor may include a power section and a bearing section, which may be operatively connected together. A drill bit may be operatively connected with the bearing section, such as at a bit box.

The power section may be configured to operatively connect with the drillstring, and may include one or more of: a power section housing; and a rotor-stator member (which may be used for creating a rotational force, such as for rotating the drill bit). The rotor-stator member may be disposed in the power section housing.

The bearing section may include a bearing section housing. The bearing section housing may include a first bend. There may also be a second bend associated with the bearing section (such as on the bearing section housing or another component thereof).

There may be a first linear section housing surface between the first bend and the second bend, as would be understood from a side or cross-sectional view thereof. The surface may lie in parallel to a reference axis.

The bearing section housing may include a lower bent section surface between the first bend a first end of the downhole motor (such as at the bit box). There may be an upper bent section surface between the second bend and a second end of the downhole motor.

As would be apparent, there may be a first bend angle with reference to the lower bent section surface and the reference axis. There may be a second bend angle with reference to the upper bent section surface and the reference axis.

In aspects, the first bend angle may be at a first absolute valve range of at least 0.1 degrees to no more than 4 degrees. In a similar manner, the second bend angle may be at a second absolute valve range of at least 0.1 degrees to no more than 4 degrees. The value may be no more than 2 degrees.

The downhole motor may include a first joint or coupling unit (such as a knuckle joint), which may be disposed at least partially within the bearing section housing. At least a portion of the lower bent section surface may be located at least axially lower than a first knuckle of the joint within the bearing section housing.

The bearing section may include other components, such as a power mandrel. In aspects, at least a first section of the power may be operatively and directly attached to the joint, and being relatively disposed within the bearing section housing. If present, a second section of the power mandrel may be operatively attached to a drill bit bit, which may be used to facilitate rotational force imparted by the rotor-stator member as transferrable to the bit to drill the wellbore. Power transfer to the power mandrel may occur within the bearing section housing.

The downhole motor may be configured to facilitate fixing a first contact point, a second contact point, and a third contact point while drilling the wellbore. The wellbore may include a deviated well or section, which may be where the three contact points occur.

The first contact point may be at the drill bit (and may at least partially be specifically be at the lower end of the bit). The second contact point may occur at or proximate to the location of the first bend. The third contact point may occur at or proximate to the location of the second bend.

A first bend length with respect to the bit box and the first bend may be in the range of at least 30 inches to no more than 70 inches. A second bend length with respect to the bit box and the second bend is in the range of 50 inches to no more than 90 inches. These lengths may be in a straight-line length.

In some aspects, there may be an intermediate section housing connected between the power section housing and the bearing section housing. In other aspects, the first bend angle may be larger than the second bend angle.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments. The drawings need not be to exact scale nor reveal every single detail of every single component, as the general operation of a downhole motor for drilling is known to one of skill in the art. Wherein:

FIG. 6A shows a schematic longitudinal side view of a system having bottom hole apparatus (BHA) configured with a stabilizer for drilling a wellbore according to embodiments of the disclosure;

FIG. 6B shows a schematic longitudinal side cross-sectional view of the system of FIG. 6A according to embodiments of the disclosure;

FIG. 6C shows a side view of a stabilizer sleeve usable with a BHA according to embodiments of the disclosure; and FIG. 6D shows a lateral cross-sectional view of a stabilizer sleeve with one or more blades according to embodiments of the disclosure.

DETAILED DESCRIPTION

Figure 1A:
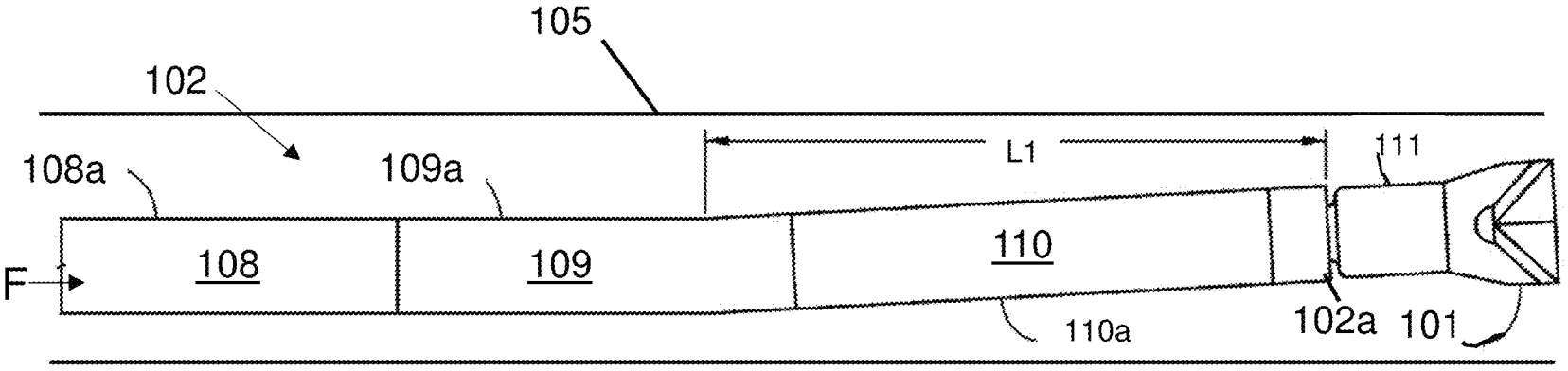
FIG. 1A (Prior Art)
FIG. 1A shows a schematic illustration of a conventional bottom hole apparatus for drilling a wellbore.
Figure 1B:
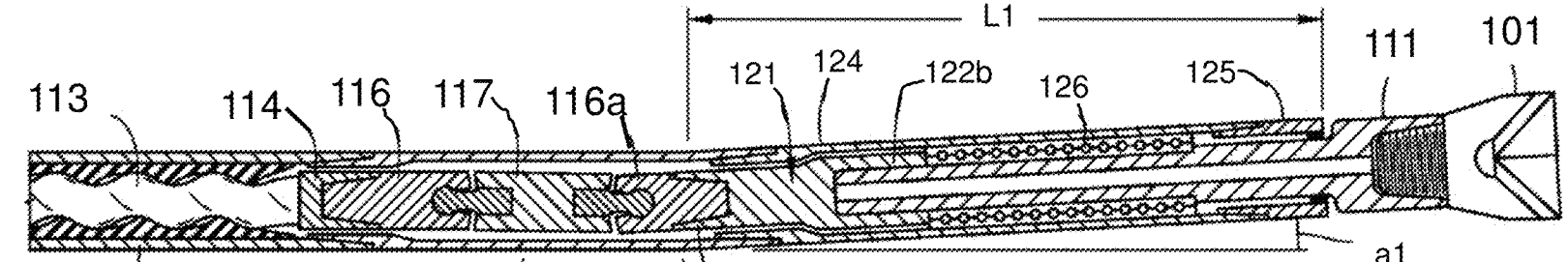
FIG. 1B (Prior Art)
FIG. 1B shows a partial cross-sectional view of the bottom hole apparatus of FIG. 1A.

Regardless of whether presently claimed herein or in another application related to or from this application, herein disclosed are novel apparatuses, units, systems, and methods that pertain to improved wellbore drilling, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional scaling materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", or the like as used herein may refer to any fluid transmission means, and may (but need not) be tubular in nature.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "workstring" as used herein may refer to any type of device (e.g., wireline, etc.) that is operable to provide some kind of action, such as drilling, running a tool, or any other kind of downhole/wellbore action, and combinations thereof. A drillstring may be a workstring, which may include use of a downhole motor and a drill bit operatively connected therewith.

The term "utility fluid" as used herein may refer to a fluid used in connection with the operation of a heat generating device, such as a lubricant or water. The utility fluid may be for heating, cooling, lubricating, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "section" as used herein may refer to a particular area or space of a downhole motor that may have one or more components operable together to perform a function. For example, the "bearing section" may include any number of components included therein useful to provide the motor with a bearing function. In certain instances, it may be the case that one or more components from one section may extend into, or also may be part of, another section.

The term "build rate" as used herein may refer to a modeled or calculated (e.g., trigonometric) curvature, expressed over a certain distance, such as 100 feet, that is the result of an inclination and azimuth (direction) difference between two survey points within a wellbore.

The term "contact point" as used herein may refer to a physical touching between a downhole motor and a wellbore surface. The downhole motor may include the drill bit or one or more housings.

The term "bend angle" as used herein may refer to a region between a surface and reference plane/axis/surface. The bend angle may be with respect to a particular view, such as in cross-section.

The term "unitary" as used herein may refer to a single piece or component. The unitary piece may be a one-piece, integral configuration in some embodiments. In other embodiments the unitary piece may be one or more pieces built together, such as via welding two pieces together or the like. As used herein 'unitary' may refer to a single piece or component that cannot be taken apart in a simple manner (such as unthreaded) without a resultant destruction of the piece or component.

Embodiments herein may be used to address inconsistencies and lack of operational efficiency attributable to a non-controllable third contact point during drilling. The Applicant has discovered that fixing or knowing a third contact point with one or more bends in the PDM may eliminate or mitigate these problems. Accordingly, a third contact point may be placed or disposed within a lower bearing section housing of a PDM motor. This position may understood relatively as above the original PDM bend used to create another or second contact point.

It may be desirous to position the new bend below the last connection in the PDM, which may increase safety by addressing radial forces that can create connection and downhole failures.

Embodiments herein may provide a fixed or controlled three-point contact in the bearing section with three PDM sections creating two connections above all three bends on the PDM. Other embodiments may provide a three-point contact in the bearing section with only two PDM sections creating only one connection above all bends on the PDM.

In accordance with the disclosure the number of BHA/PDM connections may be reduced. Any time connections can be reduced on a rotational member, the less radial and axial stresses will affect that members connections. Consequently, it is desirous to have the least number of connections within a PDM to mitigate stress failures. Embodiments herein may thus provide a single or one-connection PDM.

As understood from the disclosure a downhole motor of embodiments herein may be used to fix or predetermine a third contact point while drilling a (deviated) wellbore. This may occur via use or presence of a double bend in a bearing section housing of the downhole motor. This may accomplish improved control build rates and dog legs while reducing the amount of single bend needed to do so.

A downhole motor of embodiments herein may be used to fix, predetermine, establish, etc. a third contact point, while drilling a (deviated) wellbore. This may occur via a double bend in the bearing section housing. This configuration may be used to better control build rates and dog legs while only having one externally threaded connection that may reduce (radial) stresses on the motor.

Figure 2A:
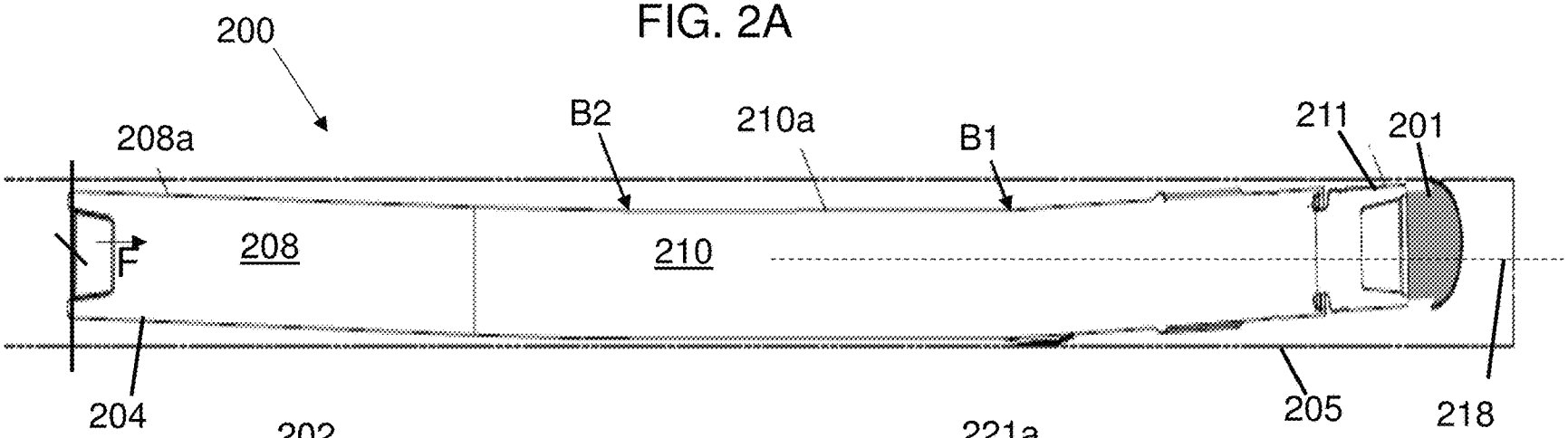
FIG. 2A shows a schematic longitudinal side view of a system having a bottom hole apparatus (BHA) for drilling a wellbore according to embodiments of the disclosure.
Figure 2B:
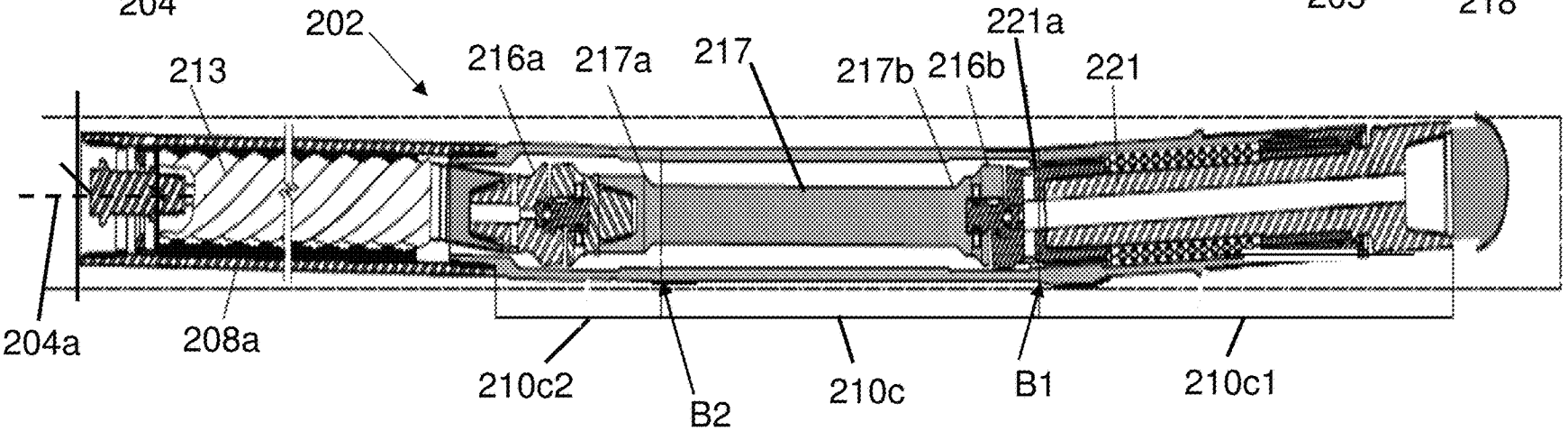
FIG. 2B shows a schematic longitudinal side cross-sectional view of the system of FIG. 2A according to embodiments of the disclosure.
Figure 2C:
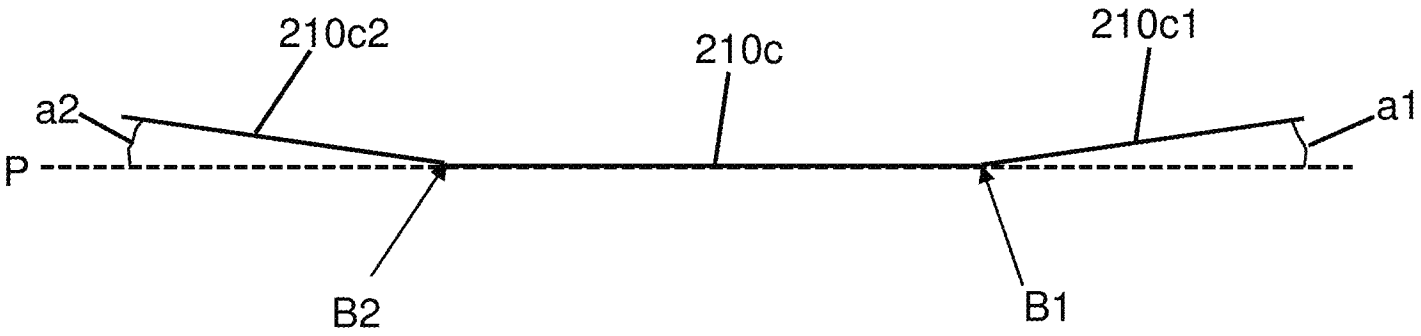
FIG. 2C shows a close-up side view of a double bend housing for a BHA according to embodiments of the disclosure.

Referring now to FIGS. 2A, 2B, and 2C, a schematic longitudinal side view of a system having a bottom hole apparatus (BHA) for drilling a wellbore, a schematic longitudinal side cross-sectional view of the system, a close-up side view of a double bend housing, respectively, illustrative of embodiments disclosed herein, are shown.

FIGS. 2A, 2B, and 2C together generally illustrates a drilling operation or system 200 that includes a workstring (drillstring) 204 configured with a downhole (mud) motor or BHA 202. The system 200 may be used to drill or form a wellbore 205 that may be vertical, horizontal, deviated, combinations thereof, etc.

One of skill would appreciate the string 204 may have an upper string portion 204*a* that extends upward in the wellbore 205, and may be connected with surface equipment, and otherwise configured for transfer of fluid F to the motor 202. The upper string portion 204*a* need not be described and/or shown in detail, as the operation of which is understood, and thus only shown in symbolic form here.

The downhole motor 202 may include one or more sections, housings, etc. As shown here, there may be a power section 208 and a bearing section 210. The power section 208 may be operatively connected with the bearing section 210. In an analogous manner, there may be a power section housing 208*a* and a bearing section housing 210*a*, which may also be (operatively) connected with each other.

The string 204 may include a bit box 211, which may be operatively connected with a drill bit 201, and may also be operatively connected to the bearing section 210. At least a portion of the bit box 211 may be disposed or housed within the bearing section housing 210*a*. The bearing section housing 210*a* may be a unitary piece. The housing 210*a* may be void of threads. Although unitary in nature, the housing 210*a* may be formed from one or more pieces put together as one (such as via snub welding, machined, or the like). A unitary piece cannot be taken apart via a simple disconnect, such as by unthreading or uncoupling.

As may be seen, the bearing section housing 210*a* may have or be associated with a first or lower bend B1, and also a second or upper bend B2. The bearing section housing 210*a* may be contemplated as having one or more linear surfaces with respect to a reference axis or plane P (i.e., when viewed in a longitudinal cross-section or a side view) (reference could also be to central, long axis 218). As shown here, the housing 210*a* may have a straight line or planar section 210*c*, which may be parrel to reference axis P. There may be a first or lower section 210*cl* (with respective surface) offset from the axis (thus having a bisect), which may be a first bend angle a1 to axis P. In an analogous manner there may be a second or upper section 210*c*2 (with respective surface) offset from the axis (thus having a bisect), which may be a first bend angle a1 to axis P. The sections 210*c*1, 210*c*2 may be referred to as bent sections.

The first bend angle a1 may be greater than the second bend angle a2 in the relative or absolute value sense. For example, the first bend angle a1 may be about 1.75 degrees, and the second bend angle a2 may be less than 1.75 degrees (e.g., 0.5 degrees). In embodiments, either bend angle a1, a2 may be in the range of about 0 degrees to about 4 degrees. As may be anticipated, the bends B1, B2 need not be mathematically or machine precise to an exact angle or point like that shown in FIG. 2C, and instead may have some amount of radius or curvature (no matter the case still yielding the angles a1, a2).

Although shown here with respect to a single reference axis, may be the case that angles a1, a2 may be aligned in any direction in relationship to each other's axial bend direction. The bend angles a1, a2 may be understood to represent the angular offset of the bend portion. It is worth noting that the power section housing 208*a* may have a straight line surface also in parallel to reference axis P. Thus, the power section housing 208*a* may be, cylindrical and not have any associated bend or bend angle.

The BHA 202 may include a rotor-stator member 213. As may be expected, the rotor-stator member 213 may be positioned or disposed (e.g., concentrically) within the power section 208. The rotor-stator member 213 may be (operatively) connected to a first or upper joint 216*a*. The first joint 216*a* need not be limited to any particular joint, such as, for example, a knuckle joint.

The first joint (or coupler, coupling unit, etc.) 216*a* may also be operatively connected with a second or lower joint 216*b*. The operative connection between joints 216*a*, 216*b* may be via a drift shaft or rod 217. The second joint 216*b* (or coupler, coupling unit, etc.) may also be operatively connected with a power mandrel or rod 221.

Both the joints 216*a*, 216*b* may be disposed or positioned within the bearing section housing 210*a*. For example, the first joint 216*a* and at least an upper drive shaft portion 217*a* (of shaft 217) may be disposed within the upper section housing end 210*c*2 of the bearing section housing 210*a*. Analogously, an at least a lower drive shaft portion 217*b* (of shaft 217) and second joint 216*b* may be disposed within the lower section housing end 210*cl*.

As touched on, the bends B1, B2 may also be disposed or formed in the bearing section housing 210*a*. By having the second joint 216*b* positioned within the bearing section housing 210*a*, the power mandrel 221 (or also 'flow diverter') may also be disposed or housed (completely) within the bearing section housing 210*a*. The power mandrel 221 is not limited to any particular shape or configuration. As an example shown here, the power mandrel 221 may be a generally elongated, straight member. In aspects, the power mandrel 221 may be cylindrical.

The power mandrel 221 may have a power mandrel section 221*a*, which may form or be part of the second joint 217*b*. In this respect, the joint connection may thus be formed or made up within bearing section housing 210*a*. The power mandrel 221 may also be operatively connected with the bit 201 (at the bit box 211).

Figure 3A:
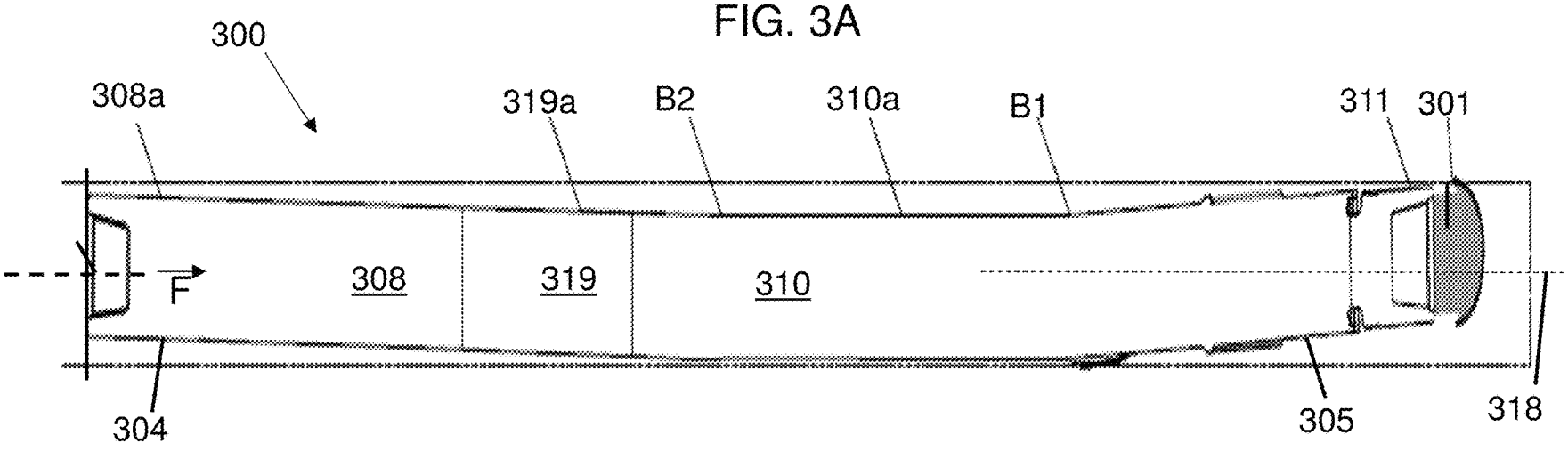
FIG. 3A shows a schematic longitudinal side view of a system having a variant BHA for drilling a wellbore according to embodiments of the disclosure.
Figure 3B:
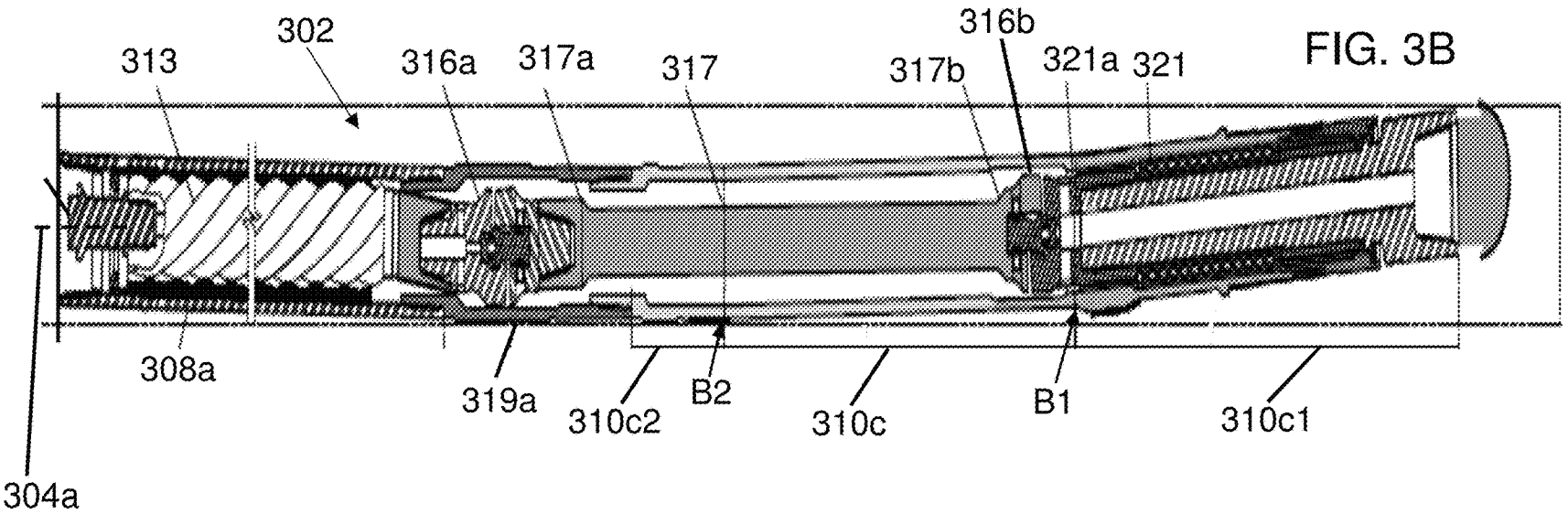
FIG. 3B shows a schematic longitudinal side cross-sectional view of the system of FIG. 3A according to embodiments of the disclosure.
Figure 3C:
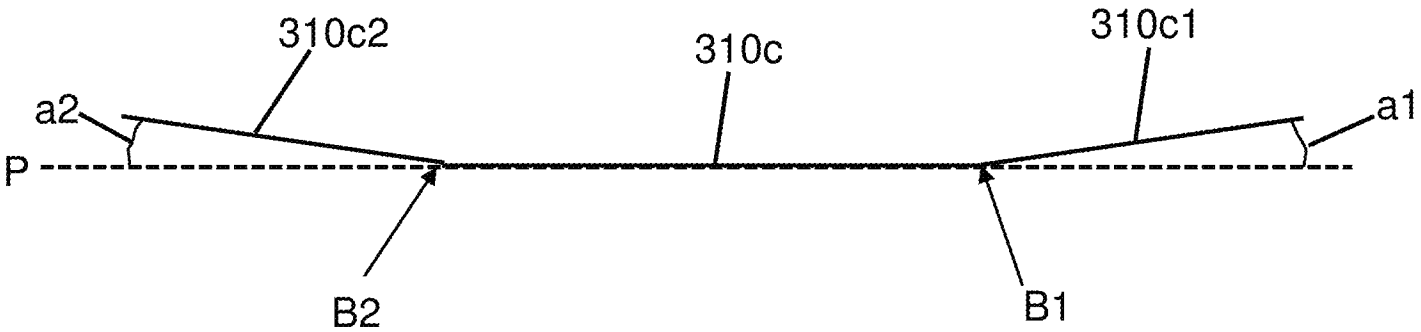
FIG. 3C shows a close-up side view of a double bend housing for a BHA according to embodiments of the disclosure.

Referring now to FIGS. 3A, 3B, and 3C, a schematic longitudinal side view of a system having a variant bottom hole apparatus (BHA) for drilling a wellbore, a schematic longitudinal side cross-sectional view of the system, a close-up side view of a double bend housing, respectively, illustrative of embodiments disclosed herein, are shown.

Downhole motor (BHA) 302 may be operated as described herein and in other embodiments (such as in System 200, etc., and so forth), and as otherwise understood to one of skill in the art. Components of the motor 302 may be arranged and disposed as described herein and in other embodiments, and as otherwise understood to one of skill in the art.

One of skill would appreciate a drillstring 304 may have an upper string portion 304*a* that extends upward in the wellbore 305, and may be connected with surface equipment, and otherwise configured for transfer of fluid F to the motor 302. The upper string portion 304*a* need not be described and/or shown in detail, as the operation of which is understood, and thus only shown in symbolic form here.

The motor 302 may be comparable or identical in aspects, function, operation, components, etc. as that of other embodiments disclosed herein. Similarities may not be discussed for the sake of brevity.

FIGS. 3A-3C together generally illustrates a drilling operation or system 300 that includes a workstring (drill-string) 304 configured with a downhole (mud) motor or BHA 302. The system 300 may be used to drill or form a wellbore 305 that may be vertical, horizontal, deviated, combinations thereof, etc.

The downhole motor 302 may include one or more sections, housings, etc. As shown here, there may be a power section 308 and a bearing section 310. The power section 308 may be operatively connected with the bearing section 310. In an analogous manner, there may be a power section housing 308*a* and a bearing section housing 310*a*, which may also be (operatively) connected with each other. In some embodiments, there may be an intermediate section 319 operatively connected with and between the power section 308 and the bearing section 310. In the same way, an intermediate section housing 319*a* may be connected between the power section housing 308*a* and the bearing section housing 310*a*. Any of the housings may be cylindrical in nature.

The string 304 may include a bit box 311, which may be operatively connected with a drill bit 301, and may also be operatively connected to the bearing section 310. At least a portion of the bit box 311 may be disposed or housed within the bearing section housing 310*a*.

As may be seen, the bearing section housing 310*a* may have or be associated with a first or lower bend B1, and also a second or upper bend B2. The bearing section housing 310*a* may be contemplated as having one or more linear surfaces with respect to a reference axis or plane P (i.e., when viewed in a longitudinal cross-section or a side view) (reference could also be to central, long axis 318). As shown here, the housing 310*a* may have a straight line or planar section 310*c*, which may be parrel to reference axis P. There may be a first or lower section 310*cl* (with respective surface) offset from the axis (thus having a bisect), which may be a first bend angle a1 to axis P. In an analogous manner there may be a second or upper section 310*c*2 (with respective surface) offset from the axis (thus having a bisect), which may be a first bend angle a1 to axis P. The sections 310*c*1, 310*c*2 may be referred to as bent sections.

The first bend angle a1 may be greater than the second bend angle a2 in the relative or absolute value sense. For example, the first bend angle a1 may be about 1.75 degrees, and the second bend angle a2 may be less than 1.75 degrees (e.g., 0.5 degrees). In embodiments, either bend angle a1, a2 may be in the range of about 0 degrees to about 4 degrees. As may be anticipated, the bends B1, B2 need not be mathematically or machine precise to an exact angle or point like that shown in FIG. 3C, and instead may have some amount of radius or curvature (no matter the case still yielding the angles a1, a2).

Although shown here with respect to a single reference axis, may be the case that angles a1, a2 may be aligned in any direction in relationship to each other's axial bend direction. The bend angles a1, a2 may be understood to represent the angular offset of the bend portion. It is worth noting that the power section housing 308*a* may have a straight-line surface also in parallel to reference axis P. Thus, the power section housing 308*a* may be, cylindrical and not have any associated bend or bend angle.

The motor/BHA 302 may include a rotor-stator member 313. As may be expected, the rotor-stator member 313 may be positioned or disposed (e.g., concentrically) within the power section 308. The rotor-stator member 313 may be (operatively) connected to a first or upper joint 316*a*. The first joint 316*a* need not be limited to any particular joint, such as, for example, a knuckle joint.

The first joint (or coupler, coupling unit, etc.) 316*a* may also be operatively connected with a second or lower joint 316*b*. The operative connection between joints 316*a*, 316*b* may be via a drift shaft or rod 317. The second joint 316*b* (or coupler, coupling unit, etc.) may also be operatively connected with a power mandrel or rod 321. End 321*a* of mandrel 321 may be part of the joint 316*b*.

At least one of the joints 316*a*, 316*b* may be disposed or positioned within intermediate bearing section housing 319*a*. For example, the first joint 316*a* and at least an upper drive shaft portion 317*a* (of shaft 317) may be disposed within the intermediate section housing 319*a*. Thus, it may be seen that neither the joint 316*a*, nor shaft portion 317*a* are within upper section housing end 310*c*2 of the bearing section housing 310*a*. On the other hand, an at least a lower drive shaft portion 317*b* (of shaft 317) and second joint 316*b* may be disposed within the lower section housing end 310*c*1.

As touched on, the bends B1, B2 may also be disposed or formed in the bearing section housing 310*a*. By having the second joint 316*b* positioned within the bearing section housing 310*a*, the power mandrel 321 (or also 'flow diverter') may also be disposed or housed (completely) within the bearing section housing 310*a*. The power mandrel 321 is not limited to any particular shape or configuration. As an example shown here, the power mandrel 321 may be a generally elongated, straight member. In aspects, the power mandrel 321 may be cylindrical.

The power mandrel 321 may have the power mandrel section 321*a*, which may form or be part of the second joint 317*b*. In this respect, the joint connection may thus be formed or made up within bearing section housing 310*a*. The power mandrel 321 may also be operatively connected with the bit 301 (at the bit box 311).

Figure 4A:
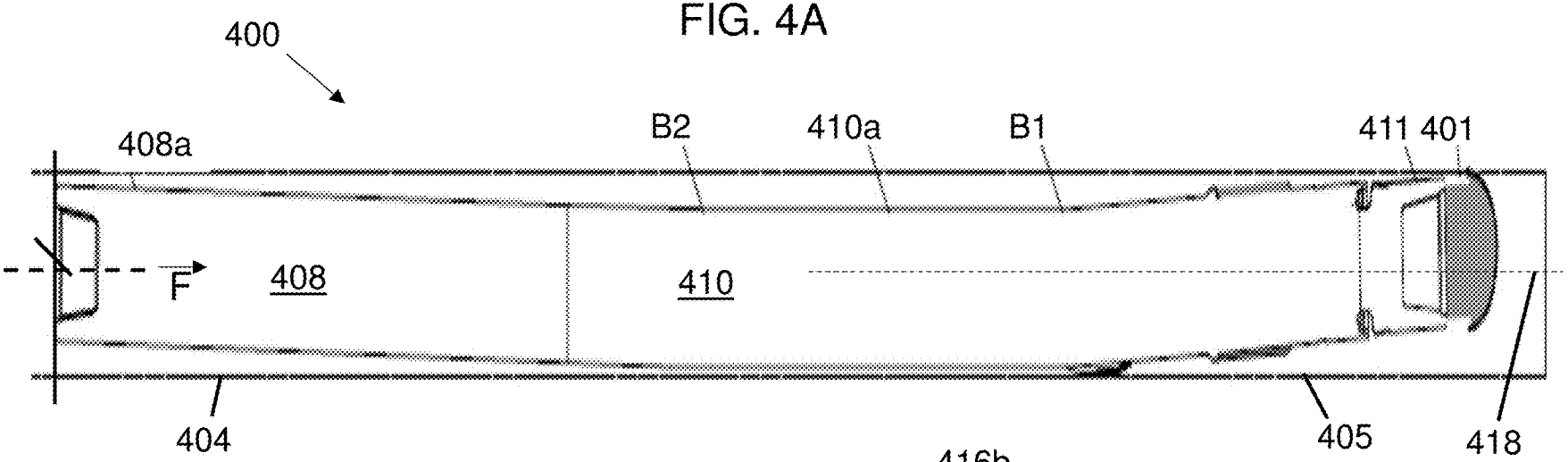
FIG. 4A shows a schematic longitudinal side view of a system having another bottom hole apparatus (BHA) for drilling a wellbore according to embodiments of the disclosure.
Figure 4B:
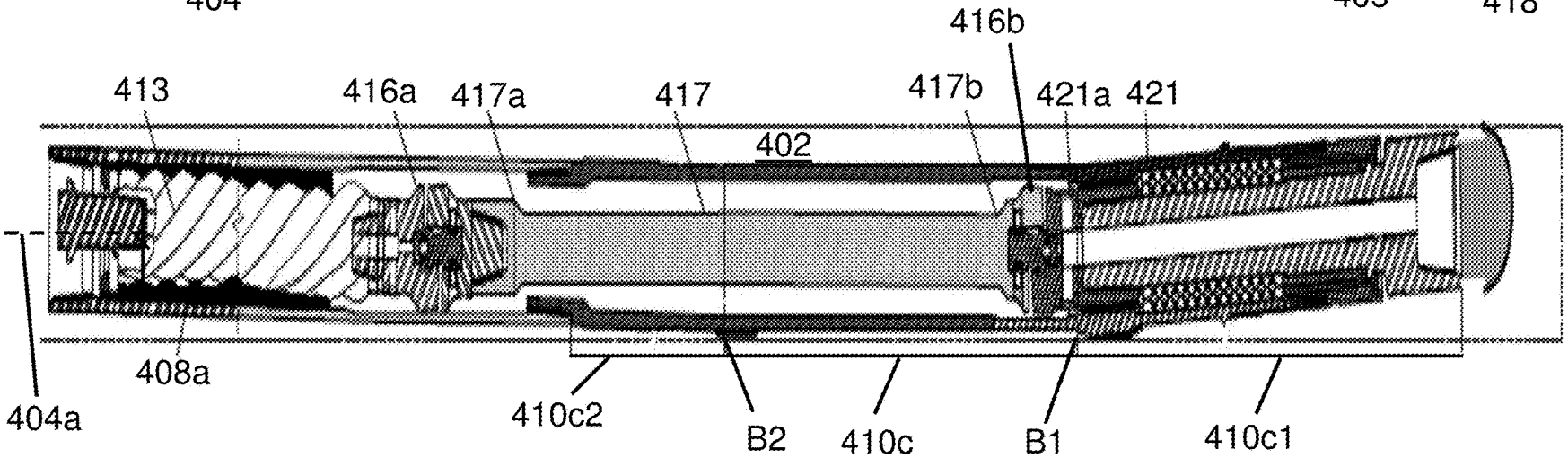
FIG. 4B shows a schematic longitudinal side cross-sectional view of the system of FIG. 4A according to embodiments of the disclosure.
Figure 4C:
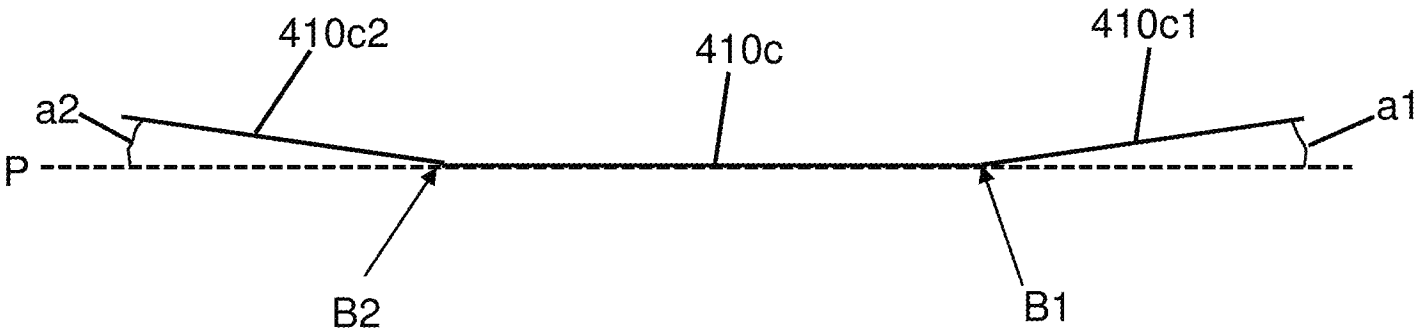
FIG. 4C shows a close-up side view of a double bend housing according to embodiments of the disclosure.

Referring now to FIGS. 4A, 4B, and 4C, a schematic longitudinal side view of a system having another bottom hole apparatus (BHA) for drilling a wellbore, a schematic longitudinal side cross-sectional view of the system, a close-up side view of a double bend housing, respectively, illustrative of embodiments disclosed herein, are shown.

Downhole motor (BHA) 402 may be operated as described herein and in other embodiments (such as in System 200, 300, etc., and so forth), and as otherwise understood to one of skill in the art. Components of the motor 402 may be arranged and disposed as described herein and in other embodiments, and as otherwise understood to one of skill in the art.

One of skill would appreciate a drillstring 404 may have an upper string portion 404*a* that extends upward in the wellbore 405, and may be connected with surface equipment, and otherwise configured for transfer of fluid F to the motor 402. The upper string portion 404*a* need not be described and/or shown in detail, as the operation of which is understood, and thus only shown in symbolic form here.

The motor 402 may be comparable or identical in aspects, function, operation, components, etc. as that of other embodiments disclosed herein. Similarities may not be discussed for the sake of brevity.

FIGS. 4A-4C together generally illustrates a drilling operation or system 400 that includes a workstring (drill-string) 404 configured with a downhole (mud) motor or BHA 402. The system 400 may be used to drill or form a wellbore 405 that may be vertical, horizontal, deviated, combinations thereof, etc.

The downhole motor 402 may include one or more sections, housings, etc. As shown here, there may be a power section 408 and a bearing section 410. The power section 408 may be operatively connected with the bearing section 410. In an analogous manner, there may be a power section housing 408*a* and a bearing section housing 410*a*, which may also be (operatively) connected with each other. Any of the housings may be cylindrical in nature, and have respective straight-line/planar (outer) surfaces.

The string 404 may include a bit box 411, which may be operatively connected with a drill bit 401, and may also be operatively connected to the bearing section 410. At least a portion of the bit box 411 may be disposed or housed within the bearing section housing 410*a*.

As may be seen, the bearing section housing 410*a* may have or be associated with a first or lower bend B1, and also a second or upper bend B2. The bearing section housing 410*a* may be contemplated as having one or more linear surfaces with respect to a reference axis or plane P (i.e., when viewed in a longitudinal cross-section or a side view) (reference could also be to central, long axis 418).

As shown here, the housing 410*a* may have a straight line or planar section 410*c*, which may be parrel to reference axis P. There may be a first or lower section 410*cl* (with respective surface) offset from the axis (thus having a bisect), which may be a first bend angle a1 to axis P. In an analogous manner there may be a second or upper section 410*c*2 (with respective surface) offset from the axis (thus having a bisect), which may be a first bend angle a1 to axis P. The sections 410*c*1, 410*c*2 may be referred to as bent sections.

The first bend angle a1 may be greater than the second bend angle a2 in the relative or absolute value sense. For example, the first bend angle a1 may be about 1.75 degrees, and the second bend angle a2 may be less than 1.75 degrees (e.g., 0.5 degrees). In embodiments, either bend angle a1, a2 may be in the range of about 0 degrees to about 4 degrees. As may be anticipated, the bends B1, B2 need not be mathematically or machine precise to an exact angle or point like that shown in FIG. 4C, and instead may have some amount of radius or curvature (no matter the case still yielding the angles a1, a2).

Although shown here with respect to a single reference axis, may be the case that angles a1, a2 may be aligned in any direction in relationship to each other's axial bend direction. The bend angles a1, a2 may be understood to represent the angular offset of the bend portion. It is worth noting that the power section housing 408*a* may have a straight line surface also in parallel to reference axis P. Thus, the power section housing 408*a* may be cylindrical and not have any associated bend or bend angle.

The BHA 402 may include a rotor-stator member 413. As may be expected, the rotor-stator member 413 may be positioned or disposed (e.g., concentrically) within the power section 408. The rotor-stator member 413 may be (operatively) connected to a first or upper joint 416*a*. The first joint 416*a* need not be limited to any particular joint, such as, for example, a knuckle joint. As shown, embodiments herein may provide for the first joint 416*a* to be relatively disposed within the power section housing 408*a* (and not within the bearing section housing 410*a*).

The first joint (or coupler, coupling unit, etc.) 416*a* may also be operatively connected with a second or lower joint 416*b*. The operative connection between joints 416*a*, 416*b* may be via a drift shaft or rod 417. The second joint 416*b* (or coupler, coupling unit, etc.) may also be operatively connected with a power mandrel or rod 421, which may be operatively connected with bit 401 (via bit box 411).

As may be seen here, only one of the joints 416*b* may be disposed or positioned within the bearing section housing 410*a*, whereas the other joint 416*a* may be disposed within the power section housing 408*a*. Other arrangements or configurations not shown here are within the scope of the disclosure. For example, there may be a short drive rod 417 which may be disposed within the bearing housing 410, which may be coupled with a drive shaft adapter that screws into the drive shaft 417 and runs up to the rotor 413 and connects.

As shown, the first joint 416*a* and at least an upper drive shaft portion 417*a* (of shaft 417) may be disposed within the power section housing 408*a*. In contrast, an at least a lower drive shaft portion 417*b* (of shaft 417) and second joint 416*b* may be disposed within the bearing section housing 410*a*. In some embodiments the lower joint 416*b* may be disposed or otherwise reside at least partially within a middle section 410*c* and a lower section housing end 410*cl*.

As touched on, the bends B1, B2 may also be disposed or formed in the bearing section housing 410*a*. By having the second joint 416*b* positioned within the bearing section housing 410*a*, the power mandrel 421 (or also 'flow diverter') may also be disposed or housed (completely) within the bearing section housing 410*a*. The power mandrel 421 is not limited to any particular shape or configuration. As an example shown here, the power mandrel 421 may be a generally elongated, straight member. In aspects, the power mandrel 421 may be cylindrical.

The power mandrel 421 may have a power mandrel section 421*a*, which may form or be part of the second joint 417*b*. In this respect, the joint connection may thus be formed or made up within bearing section housing 410*a*. The power mandrel 421 may also be operatively connected with the bit 401 (at the bit box 411).

Figure 5A:
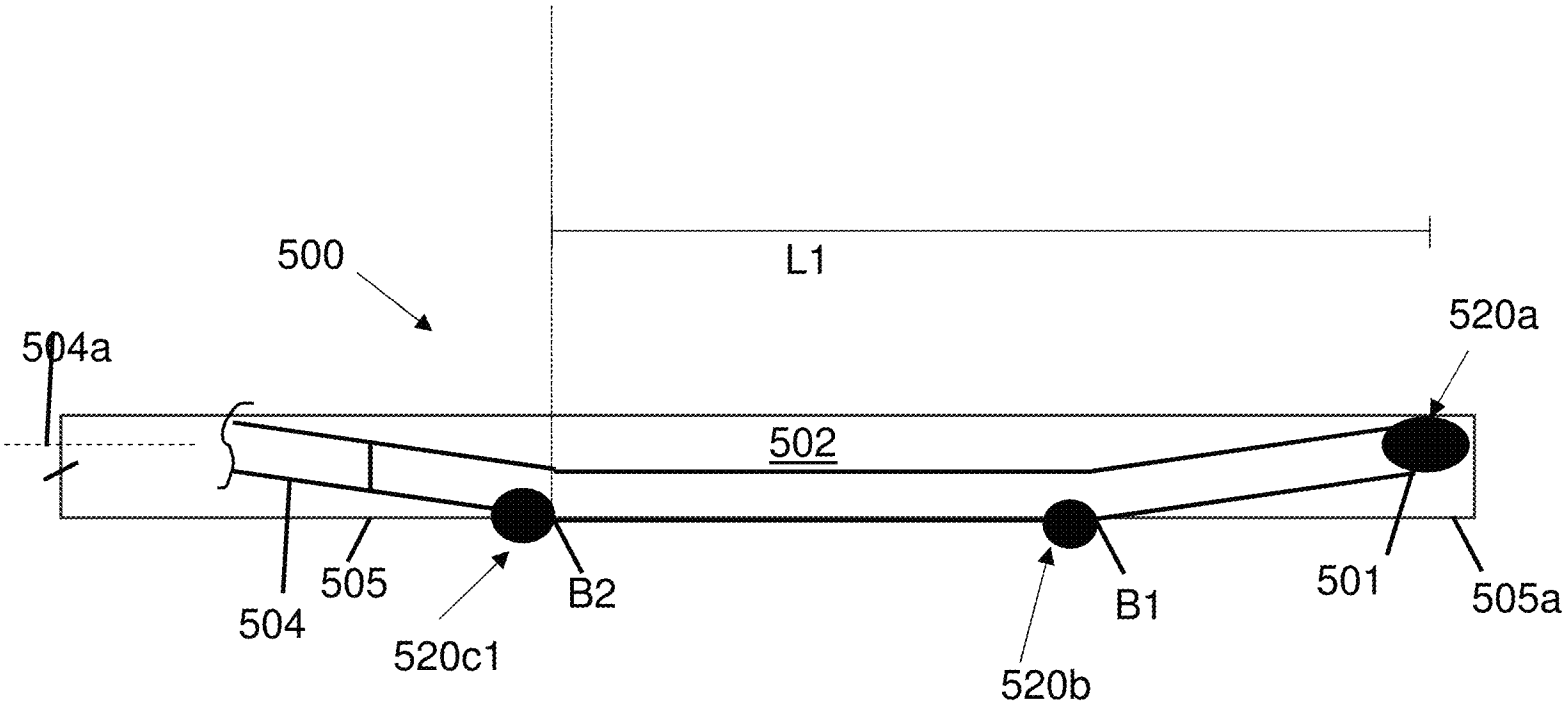
FIG. 5A shows a simplified longitudinal side view of a block diagram illustrating a drill string with three contact points with respect to a reference according to embodiments of the disclosure.
Figure 5B:
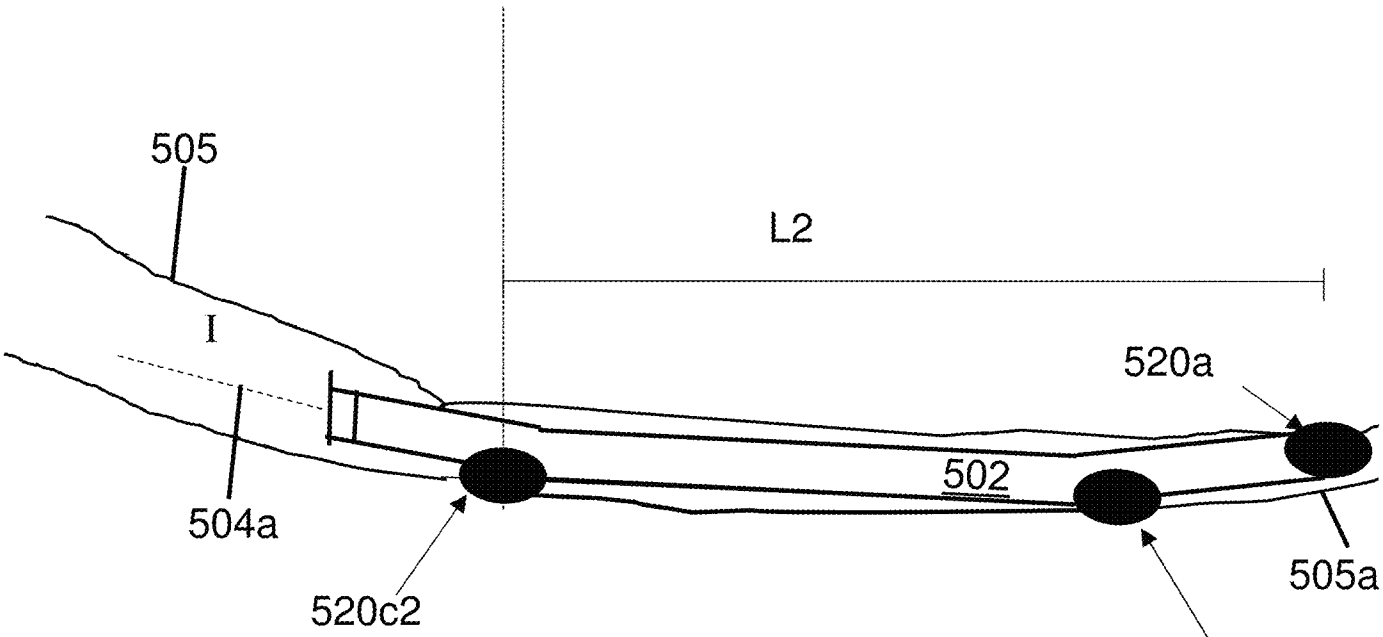
FIG. 5B shows a simplified longitudinal side view of a block diagram illustrating a downhole motor with three contact points in a wellbore arc or include according to embodiments of the disclosure.

Referring now to FIGS. 5A and 5B, a simplified longitudinal side view of a block diagram illustrating a drill string with three contact points in a wellbore, and a simplified longitudinal side view of a block diagram illustrating a downhole motor with three contact points in a wellbore with a dogleg or curvature, respectively, illustrative of embodiments disclosed herein, are shown.

FIGS. 5A and 5B show in simplified block diagram form the nature of a downhole motor 502 on the end of a drillstring 504 for use (or operationally in use) in drilling a wellbore 505. Embodiments shown and described, or otherwise understood by one of skill in the art, are applicable to all embodiments herein (e.g., for system 200, 300, and components thereof, etc.).

The wellbore 505 may include one or more vertical or horizontal sections that tend to have a linear nature or structure, such as that shown in FIG. 5A. In the reality, no wellbore will be completely linear or straight in the mathematical sense. Just the same, the wellbore 505 may include a dogleg or curvature, especially in the time that the wellbore 505 undergoes a build rate for deviated drilling. These views need not be to scale or an exact nature, and instead provide a general illustration of controlled or pre-determined contact points 520*a*, 520*b*, 520*c*½ [illustrated as exaggerated, oversized shaded circles for easy viewing and reference; the actual, physical point of contact may be more precise].

In accordance with the disclosure a bit or lower end 501 (such as for drilling in a wellbore bottom or bottom-most region 505*a*) below motor 502 may provide a first known or controlled contact point 520*a*. Due to the presence of a first bend B1 (with respective bend angle), there may be a second known or controlled contact point 520*b*.

The second contact point 520*b* may be at the first bend B1. The second contact point 520*b* may be precisely or exactly at the first bend B1 and/or in proximity thereto. The first bend B1 (and thus the second contact point 520*b*) may be positioned approximately 30 to 70 inches from the bottom of the bit box. The second contact point 520*b* may be associated with the motor 502. The second contact point 520*b* may be associated with a bearing section (or section housing, e.g., 310*a*, 410*a*, etc.) of the motor 502.

Due to the presence of a second bend B2 (with respective bend angle), there may be third known or controlled contact point 520*cl*. The third contact point 520*cl* may be associated with the drillstring 504, as shown in FIG. 5A. One of skill would appreciate additional or upper portion 504*a* of the drillstring 504 would extend further uphole, details of which not needed for the illustration and understanding of the contact points.

There may be a straight-line length L1 between the first contact point 520*a* and bend B2. More precisely, the length L1 may be with respect to the bottom of the bit box and the bend B2. The length L1 may be in the range of about 50 inches to about 90 inches.

Control or pre-determination of the length L1 may correspond to the size or nature of the bends B1, B2 (or bend angles), as well as the size and dimension of BHA 502. The location of third contact point 520*c*2 may change or vary during drilling, but in any given static moment in time may otherwise be contemplated as length L2, anticipated to be significantly proximate or adjacent bend B2, and generally at bend B2. The ratio of L2:L1 would be anticipated as approximate to 1, such as within 1.1 to 0.9 1.01 or 1.1.

As the wellbore 504 experiences or is made with an incline I (FIG. 5B), all contact points may be seen as being associated with the motor 502/bit 501, and associated with the bearing housing (e.g., 310*a*, 410*a*, etc.).

Although not shown here, in some embodiments, it may be the case that third contact point 520*c*2 may be associated with a power section (or section housing, e.g., 208*a*, 308*a*, 408*a*, etc.) of the motor 502.

With the use of bends B1, B2, the system 500 (or motor 502) may be operated with greater speed and efficiency, resulting in improved/faster curvature via higher build rates. The use of bend B2 means bend B1 may be smaller.

Referring now to FIGS. 6A, 6B, 6C, and 6D, a schematic longitudinal side view of a system having bottom hole apparatus (BHA) configured with a stabilizer for drilling a wellbore, a schematic longitudinal side cross-sectional view of the system of FIG. 6A, a side view of a stabilizer sleeve usable with a BHA, a lateral cross-sectional view of a stabilizer sleeve with one or more blades, respectively, illustrative of embodiments disclosed herein, are shown.

Downhole motor (BHA) 602 may be operated as described herein and in other embodiments (such as in System 200, 300, etc., and so forth), and as otherwise understood to one of skill in the art. Components of the motor 602 may be arranged and disposed as described herein and in other embodiments, and as otherwise understood to one of skill in the art. Thus, the motor 602 may be comparable or identical in aspects, function, operation, components, etc. as that of other embodiments disclosed herein. Similarities may not be discussed for the sake of brevity.

FIGS. 6A-6D together generally illustrate an embodiment for a drilling operation or system 600 that includes a downhole (mud) motor or BHA 602 that may be configured with a stabilizer body 630. The stabilizer body 630 may be integral to or part of bearing section 610 (or housing 610*a*). As shown by FIGS. 6C-6D, the stabilizer 630 may be a sleeve, which may couple on or around the bearing section housing 610*a* (via stabilizer bore 632).

The stabilizer 630 may be a typical stabilizer in that there may be one or more stabilizer blades 631. The blades 631 may be disposed around a periphery of the body, including in an asymmetrical or symmetrical fashion. As shown here, there may be about one to three blades disposed equidistantly to each other.

The downhole motor 602 may include one or more sections, housings, etc. As shown here, there may be a power section 608 and the bearing section 610. The power section 608 may be operatively connected with the bearing section 610. In an analogous manner, there may be a power section housing 608*a* and the bearing section housing 610*a*, which may also be (operatively) connected with each other. Any of the housings may be cylindrical in nature, and have respective straight-line/planar (outer) surfaces.

As may be seen, the bearing section housing 610*a* may have or be associated with a first or lower bend B1, and also a second or upper bend B2. The bearing section housing 410*a* may be contemplated as having one or more linear surfaces with respect to a reference axis or plane P (i.e., when viewed in a longitudinal cross-section or a side view) (reference could also be to central, long axis), as described herein.

The bearing section housing 610 may have a first or lower section (with respective surface) offset from the axis (thus having a bisect), which may be a first bend angle a1 (to an axis). In an analogous manner there may be a second or upper section (with respective surface) offset from the axis (thus having a bisect), which may be a first bend angle a2 (to axis).

The stabilizer blade 630 may have one or more angled surfaces 633 (see surface plane offset to horizonal, FIG. 6B) that may supplement or replace angle a2 (such that the angle a2 may be negligible or zero).

The first bend angle a1 may be greater than the second bend angle a2 in the relative or absolute value sense. For example, the first bend angle a1 may be about 1.75 degrees, and the second bend angle a2 may be less than 1.75 degrees (e.g., 0.5 degrees or 0.1 degrees). In embodiments, either bend angle a1, a2 may be in the range of about 0 degrees to about 4 degrees. As may be anticipated, the bends B1, B2 need not be mathematically or machine precise to an exact angle or point.

The rotor-stator member 613 may be (operatively) connected to a first or upper joint 616*a*. As shown, embodiments herein may provide for the first joint 616*a* to be relatively disposed within the power section housing 608*a* (and not within the bearing section housing 610*a*). However, the first joint 616*a* may alternatively be disposed within the bearing section 610 or housing 610*a*.

The first joint 616*a* may also be operatively connected with a second or lower joint 616*b*. The operative connection between joints 616*a*, 16*b* may be via a drift shaft or rod 617. The second joint 616*b* (or coupler, coupling unit, etc.) may also be operatively connected with a power mandrel or rod.

The bends B1, B2 of any embodiment of the disclosure may have a bitbox-end-to-bend length of the ranges described herein. For example, the bitbox to bend B1 length may be in the range of 30 inches to 70 inches, and the bitbox to bend B2 length may be in the range of 50 inches to 90 inches. The bend B2 of any embodiment may be axially lower than the position of any kind of upper coupling device or joint. The lengths may be considered straight line lengths; however, mathematical exactness need not be used, and approximate lengths are within the scope of the disclosure.

Embodiments herein may provide for a method of forming a wellbore, a portion thereof may be formed at an incline or arc, such as for deviated or horizontal drilling.

The method may include using a downhole motor that provides known or controlled contact with the drilling string (i.e., the downhole motor) and the wellbore. The method may include operating at improved build rates, and better (shorter) arc/curved portions.

The method may include the downhole motor having a unitary housing, such as a unitary bearing housing. Reducing the number of separation points within the drillstring may facilitate improved drilling and build rates.

The method may include a first known or controlled contact point with the drill bit. There may be a second and third known or controlled contact point, which may be with the downhole motor. Although not meant to be limited the method may include using the downhole motor for drilling the wellbore such that the second and third contact points occur against the bearing housing.

In embodiments the bearing housing may be associated with first and second bends, corresponding to first and second bend angles. The first bend may be where the second contact point occurs. The second bend (further uphole on the housing) may be where the third contact point occurs. All of the first, second, and third contact points may occur in the lower (last) 100 inches of the downhole motor/drill bit.

The first bend may be axially (laterally) proximate to at least a portion of a lower joint or coupling unit disposed in the motor. The second bend may be axially lower than the location of where an upper joint of a coupling unit is located.

Other embodiments pertain to a downhole motor (such as for use with a drillstring in drilling a wellbore) that may include any of: a power section, which may have a rotor-stator member for generating rotational force; a bearing section housing operatively connected to the power section. The bearing section housing may be unitary. The unitary housing may be a one-piece, integral component. In other aspects, the unitary housing may be a single one-piece component formed from two components joined together via a physical and/or chemical mechanism, such as welding.

The bearing section housing may include a first bend and a second bend, each having a respective bend angle relative to a reference axis. There may be a first linear section between the first and second bends. There may be a lower bent section between the first bend and a bit (or bit box). There may be an upper bent section between the second bend and the power section. These sections and respective surfaces may be viewed from the side or in cross section as having a linear (straight) surface, as would be clear to one of skill in the art.

There may be a coupling unit, which may be associated with a drive shaft and one or more knuckles (or knuckle joints). The knuckles may be disposed entirely within the bearing section housing. There may be a power mandrel operatively connected to the coupling unit and disposed within the bearing section housing.

The downhole motor may be configured and otherwise used to know, control, establish, etc. three contact points with the wellbore during drilling. These contact points may be: at the bit, at the first bend, and at the second bend. In some aspects, the second bend may be associated with a component coupled with the bearing housing, such as a stabilizer body or sleeve.

Other embodiments pertain to a downhole drilling system, such as for use in drilling a wellbore. The system may include a drillstring for rotating a drill bit. There may be a downhole motor operatively coupled between the drillstring and the drill bit. The downhole motor may include a power section and a bearing section. The power section may have a power section housing and the bearing section may have a bearing section housing. The bearing section housing may be a unitary housing.

The power section may include a rotor-stator member, which may be operable for generating or providing a rotational force (directly or indirectly) to the drill bit. The bearing section may be operatively connected with the power section. The bearing section may be operatively connected with the drill bit. The bearing section housing may include a first bend and a second bend, each having a respective bend angle, such was with to a reference line or axis. The system may be operable to establish or know three contact points with the wellbore during drilling: at the drill bit, at the first bend, and at the second bend.

Yet other embodiments pertain to a method of using any downhole motor of the present disclosure. The method may include providing a downhole motor that has a power section and a bearing section. The bearing section may include a first bend and a second bend. Either or both of the first bend and the second bend may be associated with a bearing section housing. The second bend may be associated with a surface, such as that of a stabilizer blade.

The method may include using the downhole motor with at least one coupling unit or joint, which may be coupled with a power mandrel. Each of these components may be disposed within the bearing section.

The method may include positioning the downhole motor within a drillstring, and the drillstring with the downhole motor into the wellbore. The method may include rotating the drillstring in a rotary or drill mode to maintain a first trajectory, which may be first or straight (such as vertical).

The method may include switching to a sliding mode to steer the drill bit using an (angular) offset created by the first and second bends. In this respect, the method may include establishing or creating three contact points with drillstring and the wellbore. The three contact points may be used to control build rate and dogleg severity. The method may include resuming rotary mode once the desired trajectory is achieved.

Embodiments herein may provide for a bearing section housing for use with a downhole motor. The bearing section housing may be a unitary body formed from one or more welded components. The bearing section housing may have a first bend and a second bend. Either or both of the bends may have respective bend angle between 0.1 and 4 degrees.

The housing may include a first linear section between the bends, which may be aligned (such as parallel) with a reference axis. The housing may include an internal cavity configured to house one or more components, such as a coupling unit and a power mandrel.

In aspects, the housing may be free of threaded connections between the first and second bends. The housing may be unitary in nature, which means the housing would require some kind of physical damage or deformation in order to separate back into two or more pieces. The housing may be used to know or establish two additional contact points (in addition to the drill bit) with a wellbore surface during drilling.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole motor for use with a drillstring in drilling a wellbore, the downhole motor comprising:

a power section configured to operatively connect with the drillstring, the power section comprising: a power section housing; and a rotor-stator member for creating a rotational force, the rotor-stator member disposed in the power section housing;

a bit box;

a bearing section operatively connected with the power section, the bearing section comprising:

a bearing section housing coupled to the power section housing, the bearing section housing comprising:

a first bend;

a second bend;

a bearing section housing surface between the first bend and the second bend lying in parallel to a reference axis;

a lower bent section surface between the first bend a first end of the downhole motor;

an upper bent section surface between the second bend and a second end of the downhole motor;

a first bend angle with reference to the lower bent section surface and the reference axis; and a second bend angle with reference to the upper bent section surface and the reference axis;

a joint disposed at least partially within the bearing section housing;

wherein the first bend angle is at a first absolute value range of at least 0.1 degrees to no more than 4 degrees, wherein the second bend angle is at a second absolute value range of at least 0.1 degrees to no more than 2 degrees, wherein the second contact point occurs at or proximate to the location of the first bend, and wherein the third contact point occurs at or proximate to the location of the second bend.

2. The downhole motor of claim 1, wherein at least a portion of the lower bent section surface is located at least axially lower than a first knuckle of the joint within the bearing section housing.

3. The downhole motor of claim 1, the bearing section further comprising a power mandrel, whereby at least a first section of the power mandrel is operatively and directly attached to the joint, and being relatively disposed within the bearing section housing.

4. The downhole motor of claim 3, wherein a second section of the power mandrel is operatively attached to a drill bit so that the rotational force imparted by the rotor-stator member is transferred to the bit to drill the wellbore, and further wherein power transfer to the power mandrel occurs within the bearing section housing.

5. The downhole motor of claim 1, wherein the downhole motor is configured to facilitate fixing a first contact point, a second contact point, and a third contact point while drilling the wellbore, and wherein the wellbore comprises a deviated well or section.

6. A downhole drilling system for use in drilling a wellbore, the system comprising:

a drillstring for rotating a drill bit;

a downhole motor operatively coupled between the drillstring and the drill bit, the downhole motor comprising:

a power section configured to operatively connect with the drillstring, the power section comprising: a power section housing; and a rotor-stator member for creating a rotational force transferrable to the drill bit, the rotor-stator member disposed in the power section housing;

a bearing section operatively connected with the power section, the bearing section comprising:

a bearing section housing coupled to the power section housing, the bearing section housing comprising:

a first bend;

a second bend;

a bearing section housing surface between the first bend and the second bend lying in parallel to a reference axis;

a lower bent section surface between the first bend a first end of the downhole motor;

an upper bent section surface between the second bend and a second end of the downhole motor;

a first bend angle with reference to the lower bent section surface and the reference axis; and a second bend angle with reference to the upper bent section surface and the reference axis;

a lower coupling unit disposed at least partially axially proximate to the first bend;

a drive shaft operatively coupled between the rotor-stator member and the lower coupling unit;

a power mandrel operatively coupled with the lower coupling unit; and an intermediate section housing connected between the power section housing and the bearing section housing, wherein the first bend angle is at a first absolute value range of at least 0.1 degrees to no more than 4 degrees, wherein the second bend angle is at a second absolute value range of at least 0.1 degrees to no more than 2 degrees, and wherein the drillbit provides a first contact point with the wellbore, and the bearing section housing provides a second contact point with the wellbore, and at least one other surface of the downhole motor provides a third contact point with the wellbore.

7. The drilling system of claim 6, wherein the first bend angle is larger than the second bend angle.

8. The drilling system of claim 6, wherein an upper coupling unit is disposed within the downhole motor axially above the second bend, and wherein the drive shaft is also coupled with the upper coupling unit.

9. The drilling system of claim 6, wherein the bearing section housing is a unitary component void of any threaded surface between the first bend and the second bend.

10. The drilling system of claim 6, wherein the bearing section housing is a unitary component formed from joining at least two separate pieces via a weld.

11. A downhole drilling system for use in drilling a wellbore, the system comprising:

a drillstring for rotating a drill bit;

a downhole motor operatively coupled between the drillstring and the drill bit, the downhole motor comprising:

a power section configured to operatively connect with the drillstring, the power section comprising: a power section housing; and a rotor-stator member for creating a rotational force transferrable to the drill bit, the rotor-stator member disposed in the power section housing;

a bearing section operatively connected with the power section, the bearing section comprising:

a bearing section housing coupled to the power section housing, the bearing section housing comprising:

a first bend;

a second bend;

a bearing section housing surface between the first bend and the second bend, the bearing section housing surface lying in parallel to a reference axis;

a lower bent section surface between the first bend and a first end of the downhole motor;

an upper bent section surface between the second bend and a second end of the downhole motor;

a first bend angle with reference to the lower bent section surface and the reference axis; and a second bend angle with reference to the upper bent section surface and the reference axis;

a lower coupling unit disposed at least partially axially proximate to the first bend;

a drive shaft operatively coupled between the rotor-stator member and the lower coupling unit;

a power mandrel operatively coupled with the lower coupling unit; and an intermediate section housing is connected between the power section housing and the bearing section housing, wherein the second bend is associated with either of: a stabilizer blade or a surface of the bearing section housing, and wherein the drillbit provides a first contact point with the wellbore, and the bearing section housing provides a second contact point with the wellbore, and at least one other surface of the downhole motor provides a third contact point with the wellbore, wherein the first bend angle is at a first absolute value range of at least 0.1 degrees to no more than 4 degrees, and wherein the second bend angle is at a second absolute value range of at least 0.1 degrees to no more than 2 degrees.

12. The drilling system of claim 11, wherein the first bend angle is larger than the second bend angle.

13. The drilling system of claim 11, wherein an upper coupling unit is disposed within the downhole motor axially above the second bend, and wherein the drive shaft is also coupled with the upper coupling unit.

14. The drilling system of claim 11, wherein the bearing section housing is a unitary component that cannot be put into two or more pieces without physical damage to the structure of the bearing section housing.

* * * * *